US006986186B1

(12) United States Patent
Dube

(10) Patent No.: US 6,986,186 B1
(45) Date of Patent: Jan. 17, 2006

(54) WINDOW WASHING SYSTEM

(76) Inventor: Stephane Dube, 1885 Montee Du BoisFranc, St. Adolphe D'Howard (CA) J0T 2B0

( * ) Notice: Subject to any disclaimer, the term of this patent is extended or adjusted under 35 U.S.C. 154(b) by 0 days.

(21) Appl. No.: 10/769,237

(22) Filed: Feb. 2, 2004

(51) Int. Cl.
*A47L 1/02* (2006.01)

(52) U.S. Cl. ..... 15/250.01; 15/250.11; 15/250.24; 15/250.29

(58) Field of Classification Search ..... 15/250.11, 15/103, 250.01, 250.24, 250.29
See application file for complete search history.

(56) References Cited

U.S. PATENT DOCUMENTS

| | | | | | |
|---|---|---|---|---|---|
| 706,834 | A | * | 8/1902 | Lawlor | 15/250.11 |
| 716,442 | A | * | 12/1902 | Lawlor | 15/250.11 |
| 1,348,443 | A | * | 8/1920 | Piggott | 15/250.24 |
| 1,661,918 | A | | 3/1928 | Beno | |
| 1,766,550 | A | * | 6/1930 | Schubert | 15/250.04 |
| 1,932,192 | A | * | 10/1933 | Smith | 15/250.11 |
| 2,086,054 | A | * | 7/1937 | Swenson | 15/250.11 |
| 2,171,721 | A | * | 9/1939 | Bingell | 15/250.11 |
| 2,509,513 | A | | 5/1950 | Fisher | |
| 2,940,110 | A | * | 6/1960 | Neal | 15/250.4 |
| 3,378,875 | A | * | 4/1968 | Kern | 15/250.04 |
| 3,461,476 | A | * | 8/1969 | North | 15/250.04 |
| 4,198,724 | A | | 4/1980 | Fisher et al. | |
| 4,257,138 | A | * | 3/1981 | Clements et al. | 15/4 |
| 4,873,740 | A | | 10/1989 | Vahrenwald et al. | |
| 5,009,189 | A | | 4/1991 | Neff | |
| 5,179,758 | A | | 1/1993 | Smith et al. | |
| 5,249,326 | A | | 10/1993 | Jeffries et al. | |
| 5,890,250 | A | | 4/1999 | Lange et al. | |

FOREIGN PATENT DOCUMENTS

| | | | |
|---|---|---|---|
| EP | 0047344 | * | 3/1982 |
| GB | 2263057 | * | 7/1993 |

* cited by examiner

*Primary Examiner*—Gary K. Graham

(57) ABSTRACT

A window washing system for cleaning a window mounted in a dwelling wall having an inner surface and an outer surface includes a window squeegee assembly that is attached to the outer surface. The assembly includes a pair of supports that are each elongated and attached to the outer surface on either side of the window. An elongated elastomeric blade is attached to and extends between the supports. The blade has a contacting edge abutting an outer surface of the window. A driving assembly is mechanically coupled to the pair of supports for selectively moving the blade upwardly or downwardly. A liquid dispenser for selectively dispensing liquid on the window. A reservoir is fluidly coupled to the dispenser by a conduit.

11 Claims, 4 Drawing Sheets

WINDOW WASHING SYSTEM

BACKGROUND OF THE INVENTION

1. Field of the Invention

The present invention relates to window washing devices and more particularly pertains to a new window washing device for selectively washing the outer surface of a window in an automated manner.

2. Description of the Prior Art

The use of window washing devices is known in the prior art. While these devices fulfill their respective, particular objectives and requirements, the need remains for a device that provides the user of the device a way in which to operate the device from within a dwelling. This should not only include the movement of a cleaning assembly across a window, but also to fill up a reservoir with cleaning fluid that may be applied to the window.

SUMMARY OF THE INVENTION

The present invention meets the needs presented above by comprising a system for selectively cleaning a window mounted in a dwelling wall and having an inner surface and an outer surface. The system includes a window squeegee assembly that is attached to the outer surface. The assembly includes a pair of supports that are each elongated and attached to the outer surface of the dwelling in a vertical orientation. The supports are positioned on either side of the window. An elongated elastomeric blade is attached to and extends between the supports. The blade has a contacting edge abutting an outer surface of the window. A driving assembly is mechanically coupled to the pair of supports for selectively moving the blade upwardly or downwardly. A liquid dispenser for selectively dispensing liquid on the window is attached to the outer surface of the dwelling wall adjacent to an upper edge of the window. The liquid dispenser includes a horizontally orientated tubular member has a plurality of outlets directed toward the window. A reservoir is fluidly coupled to the dispenser by a conduit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
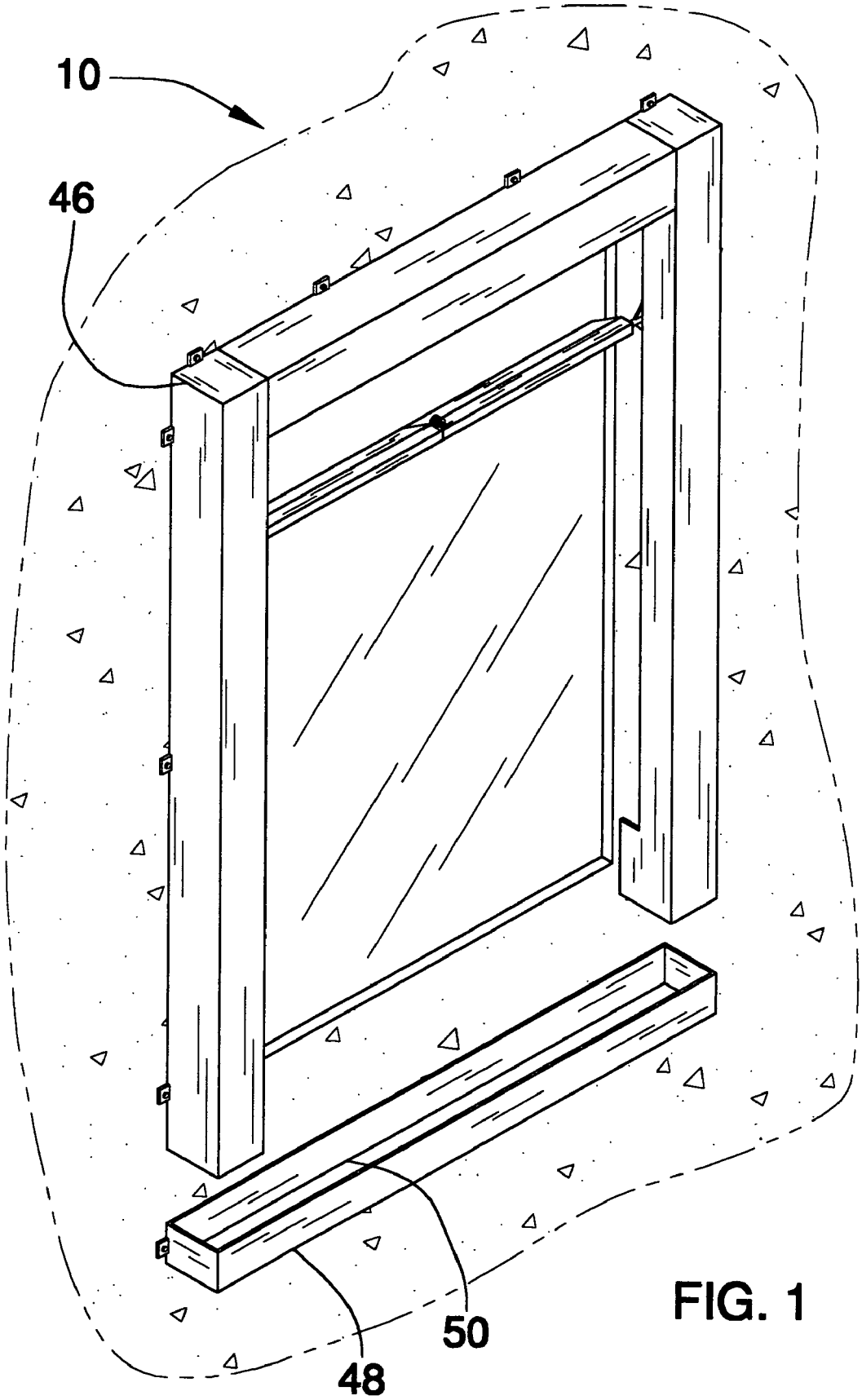
FIG. 1 is a schematic perspective view of a window washing system according to the present invention.
Figure 2:
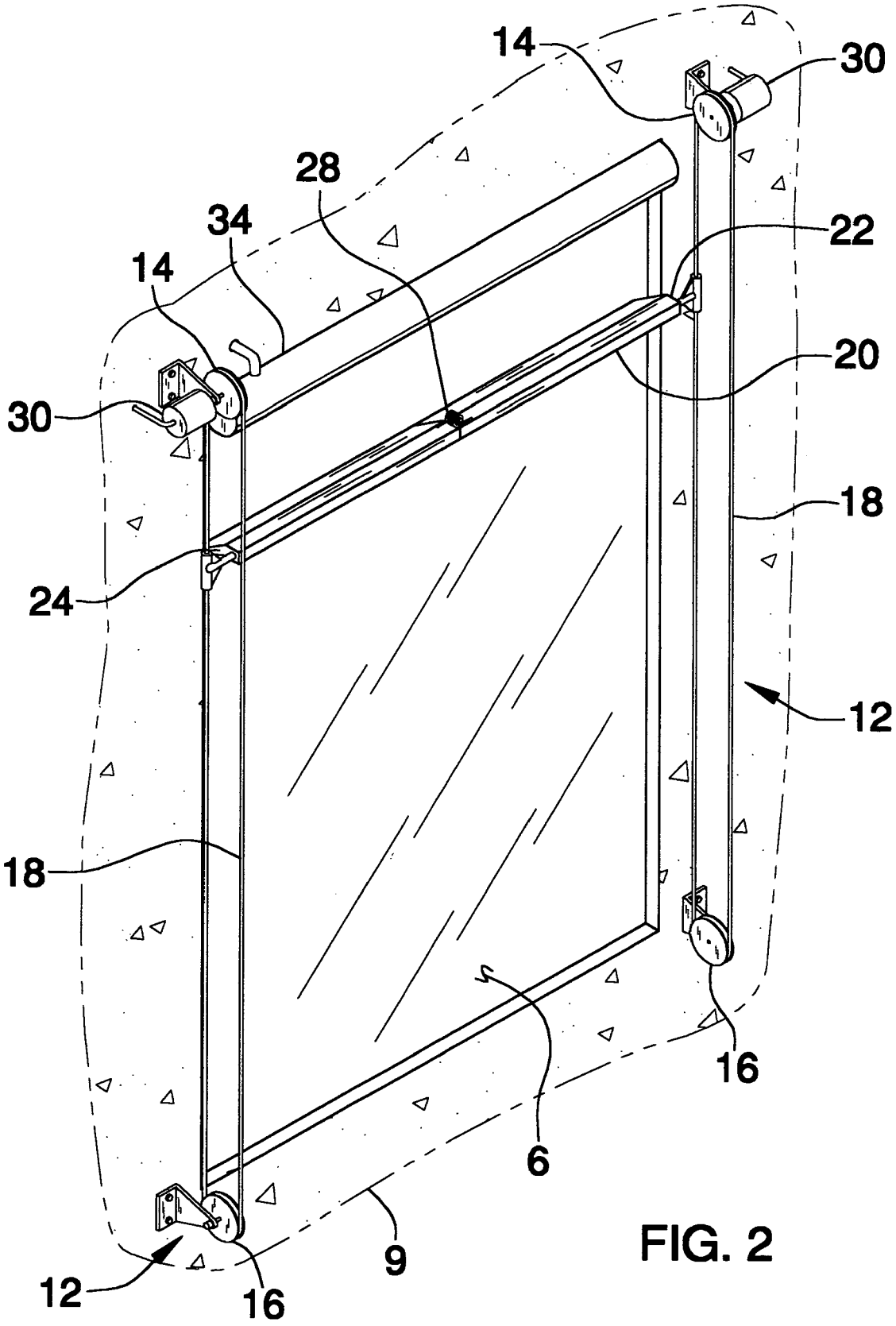
FIG. 2 is a schematic perspective view of the present invention.
Figure 3:
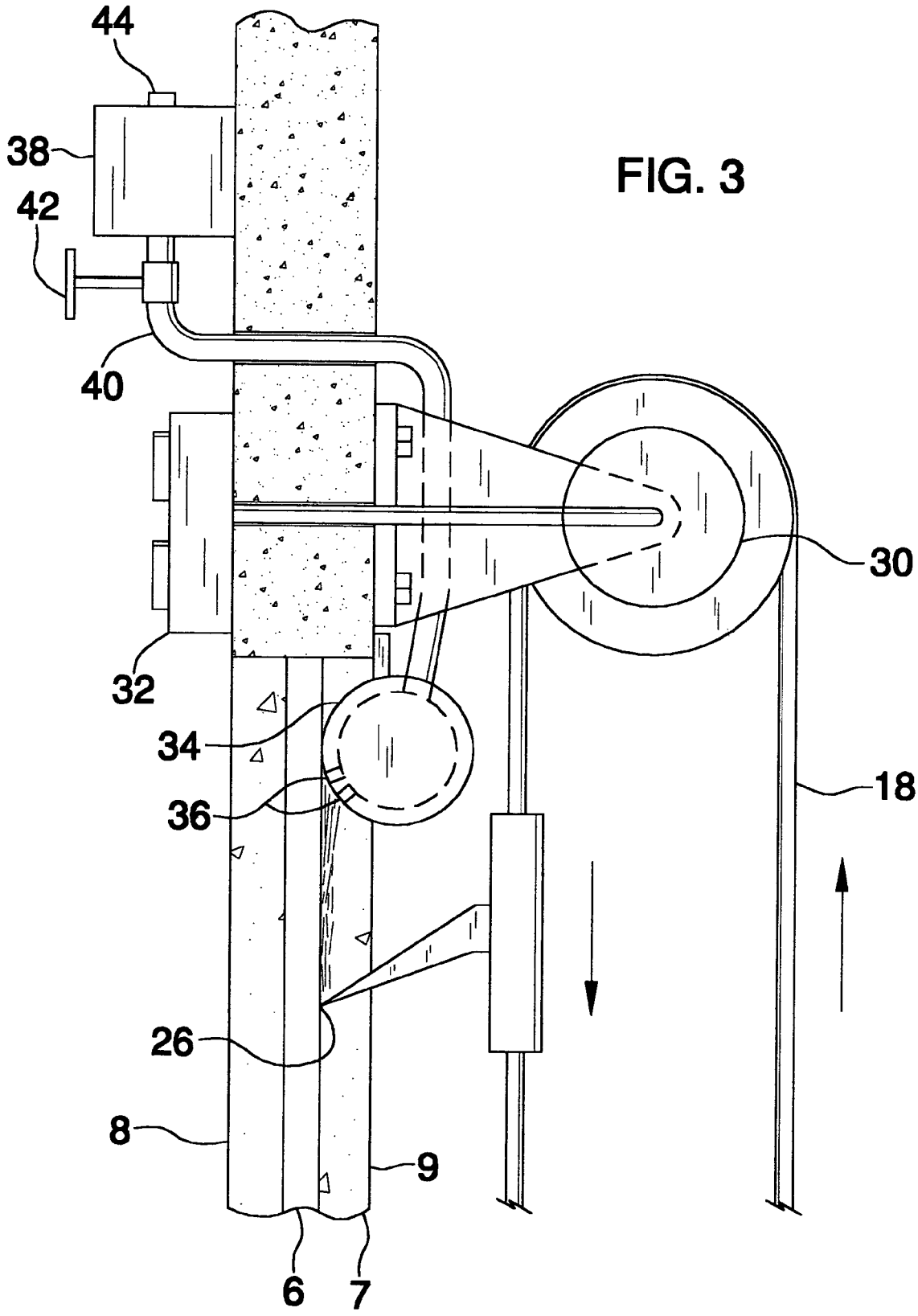
FIG. 3 is a schematic side view of the present invention .
Figure 4:
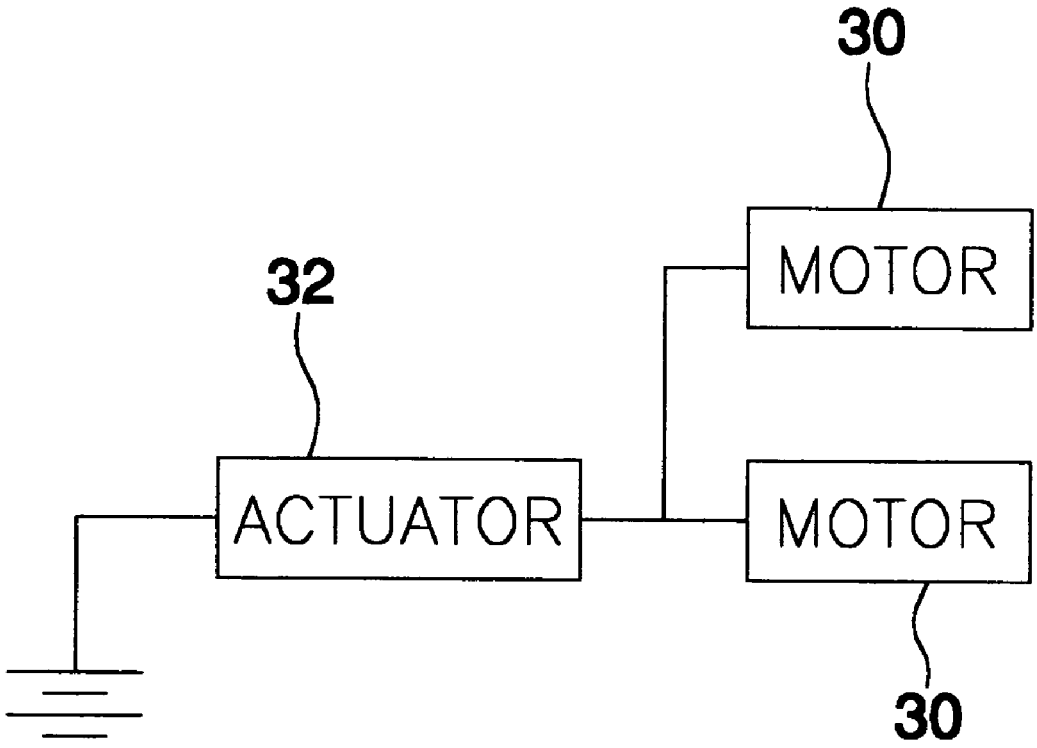
FIG. 4 is an electrical schematic view of the present invention.

With reference now to the drawings, and in particular to FIGS. 1 through 4 thereof, a new window washing device embodying the principles and concepts of the present invention and generally designated by the reference numeral 10 will be described.

As best illustrated in FIGS. 1 through 4, the window washing system 10 generally comprises a system for selectively cleaning a window 6 of a dwelling. The window 6 being conventional and which is mounted in a dwelling wall 7 having an inner surface 8 and an outer surface 9.

The system includes a window squeegee assembly that is attached to the outer surface 9. The assembly includes a pair of supports 12. Each of the supports 12 is elongated and is attached to the outer surface 9 of the dwelling in a vertical orientation. The supports 12 are positioned on either side of the window 6. Each of the supports 12 includes an upper pulley 14, a lower pulley 16 and a cable 18 that forms a loop and extends around the upper 14 and lower 16 pulleys. Alternatively, a chain may replace the cable 18 and the pulleys 14, 16 replaced with gears having teeth for engaging the chain. An elongated blade 20 comprising an elastomeric material is attached to and extends between the supports 12. The blade 20 has a first end 22 attached to a first of the cables 18 and a second end 24 attached to a second of the cables 18. The blade 20 has a contacting edge 26 abutting an outer surface of the window 6. The contacting edge 26 is preferably pointed and angled downward with respect to the window 6. The blade 20 is ideally comprised of a resiliently elastic elastomeric material and a tension spring 28 may be mounted on the blade 20 to ensure that the blade 20 remains abutted against the window 6 in a downward orientation. A driving assembly is mechanically coupled to the pair of supports 12 for selectively moving the blade 20 upwardly or downwardly. The driving assembly preferably includes a pair of motors 30 each mechanically coupled to one of the upper pulleys 14 and an actuator 32 for selectively causing the motors 30 to simultaneously rotate the upper pulleys 14 in a first direction or a second direction. The actuator 32 is mounted on the inner surface 8 of the dwelling wall 7. The actuator 32 may be hardwired into the dwelling's electrical system or it may include a conventional power plug for providing power to the motors 30.

A liquid dispenser 34 for selectively dispensing liquid on the window 6 is attached to the outer surface 9 of the dwelling wall 7 adjacent to, and preferably abutted against, an upper edge of the window 6. The liquid dispenser 34 includes a horizontally orientated tubular member extending along a length of the window 6 and has a plurality of outlets 36 directed toward the window 6 that extend along a length of the tubular member. A reservoir 38 is fluidly coupled to the dispenser 34 by a conduit 40. A valve 42 is fluidly coupled to the conduit 40 for selectively opening or closing the conduit 40. The reservoir 38 is mounted on the inner surface 8 of the dwelling wall 7 and above the window 6. The valve 42 is preferably mounted adjacent to the reservoir so that it located within the dwelling. The reservoir 38 includes an opening 44 and is selectively filled with a cleaning solution that is dispensed by gravitational force through the conduit 40, into the liquid dispenser 34 and outwardly through the outlets 36. It is preferred that the outlets 36 are adjacent to the window 6 so that pumps are not required.

A covering 46 is removably attached to the outer surface 9 of the dwelling wall 7 for covering each of the pair of supports 12 and the liquid dispenser 34. The covering preferably includes an upper portion and two side portions for easy fitting. This allows for a cleaner appearance and color coordinating of the system 10 with an exterior of the dwelling. A trough 48 is removably attached to the outer surface 9 of the dwelling wall 7 and positioned below the window 6. The trough 48 has an open upper side 50 for retaining water released by the liquid dispenser 34 where it may evaporate instead of traveling down the side of the dwelling.

In use, the system 10 is mounted on the dwelling as indicated above. The user releases cleaning fluid onto the window 6 and selectively moves the blade 20 upwardly and downwardly on the window 6 until the window is clean. By keeping the actuator 32 and reservoir 38 is the dwelling, the user need not open the window 6 or go outside to clean the windows 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic window washing system for selectively cleaning a window of a dwelling, the window being mounted in a dwelling wall having an inner surface and an outer surface, said system comprising:

a window squeegee assembly being attached to said outer surface, said assembly including:

a pair of supports, each of said supports being elongated and attached to the outer surface of the dwelling in a vertical orientation, said supports being positioned on either side of said window, each of said supports including an upper pulley, a lower pulley and a cable forming a loop and extending around said upper and lower pulleys, an elongated blade having a first end attached to a first of said cables and a second end attached to a second of said cables;

said elongated blade comprising an elastomeric material being attached to and extending between said supports, said blade having a contacting edge abutting an outer surface of the window, said contacting edge being pointed and angled downward with respect to the window;

a driving assembly being mechanically coupled to said pair of supports for selectively moving said blade upwardly or downwardly;

a liquid dispenser for selectively dispensing liquid on said window being attached to the outer surface of the dwelling wall adjacent to an upper edge of the window, said liquid dispenser including a horizontally oriented tubular member having a plurality of outlets directed toward the window; and a reservoir being fluidly coupled to said dispenser by a conduit.

2. The system of claim 1, wherein said driving assembly includes a pair of motors each mechanically coupled to one of said upper pulleys and an actuator for selectively causing said motors to simultaneously rotate said upper pulleys in a first direction or a second direction.

3. The system of claim 2, wherein said actuator is mounted on the inner surface of the dwelling wall.

4. The system of claim 1, further including a valve being fluidly coupled to said conduit for selectively opening or closing said conduit.

5. The system of claim 4, wherein said reservoir is mounted on the inner surface of the dwelling wall and above the window.

6. The system of claim 5, wherein said valve is positioned adjacent to said reservoir.

7. The system of claim 1, further including a covering being removably attached to the outer surface of the dwelling wall for covering each of said pair of supports and said liquid dispenser.

8. The system of claim 7, further including a trough being removably attached to the outer surface of the dwelling wall and positioned below the window, said trough having an open upper side for retaining wall released by said liquid dispenser.

9. The system of claim 1, further including a trough being removably attached to the outer surface of the dwelling wall and positioned below the window, said trough having an open upper side for retaining water released by said liquid dispenser.

10. An automatic window washing system for selectively cleaning a window of a dwelling, the window being mounted in a dwelling wall having an inner surface and an outer surface, said system comprising:

a window squeegee assembly being attached to said outer surface, said assembly including;

a pair of supports, each of said supports being elongated and attached to the outer surface of the dwelling in a vertical orientation, said supports being positioned on either side of said window, each of said supports including an upper pulley, a lower pulley and a cable forming a loop and extending around said upper and lower pulleys;

an elongated blade comprising an elastomeric material being attached to and extending between said supports, said blade having a first end attached to a first of said cables and a second end attached to a second of said cables, said blade having a contacting edge abutting an outer surface of the window, said contacting edge being pointed and being angled downward with respect to the window;

a driving assembly being mechanically coupled to said pair of supports for selectively moving said blade upwardly or downwardly, said driving assembly including a pair of motors each mechanically coupled to one of said upper pulleys and an actuator for selectively causing said motors to simultaneously rotate said upper pulleys in a first direction or a second direction, said actuator being mounted on the inner surface of the dwelling wall;

a liquid dispenser for selectively dispensing liquid on said window being attached to the outer surface of the dwelling wall adjacent to an upper edge of the window, said liquid dispenser including a horizontally orientated tubular member having a plurality of outlets directed toward the window;

a reservoir being fluidly coupled to said dispenser by a conduit, a valve being fluidly coupled to said conduit for selectively opening or closing said conduit, said reservoir being mounted on the inner surface of the dwelling wall and above the window;

a covering being removably attached to the outer surface of the dwelling wall for covering each of said pair of supports and said liquid dispenser; and a trough being removably attached to the outer surface of the dwelling wall and positioned below the window, said trough having an open upper side for retaining water released by said liquid dispenser.

11. An automatic window washing system for selectively cleaning a window of a dwelling, the window being mounted in a dwelling wall having an inner surface and an outer surface, said system comprising:

a window squeegee assembly being attached to said outer surface, said assembly including;

a pair of supports, each of said supports being elongated and attached to the outer surface of the dwelling in a vertical orientation, said supports being positioned on either side of said window, each of said supports including an upper pulley, a lower pulley and a cable forming a loop and extending around said upper and lower pulleys, an elongated blade having a first end attached to a first of said cables and a second end attached to a second of said cables;

said elongated blade comprising an elastomeric material being attached to and extending between said supports, said blade having a contacting edge abutting an outer surface of the window;

a driving assembly being mechanically coupled to said pair of supports for selectively moving said blade upwardly or downwardly, said driving assembly including a pair of motors each mechanically coupled to one of said upper pulleys and an actuator for selectively causing said motors to simultaneously rotate said upper pulleys in a first direction or a second direction;

a liquid dispenser for selectively dispensing liquid on said window being attached to the outer surface of the dwelling wall adjacent to an upper edge of the window, said liquid dispenser including a horizontally orientated tubular member having a plurality of outlets directed toward the window; and a reservoir being fluidly coupled to said dispenser by a conduit.

* * * * *